US011069301B2

(12) United States Patent
Cho et al.

(10) Patent No.: US 11,069,301 B2
(45) Date of Patent: Jul. 20, 2021

(54) DISPLAY DEVICE

(71) Applicant: LG Display Co., Ltd., Seoul (KR)

(72) Inventors: Soon-Dong Cho, Gumi-si (KR); Jung-Jae Kim, Goyang-si (KR); Sang-Uk Lee, Seoul (KR); Hyung-Jin Choe, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 99 days.

(21) Appl. No.: 16/225,753

(22) Filed: Dec. 19, 2018

(65) Prior Publication Data

US 2019/0197964 A1 Jun. 27, 2019

(30) Foreign Application Priority Data

Dec. 22, 2017 (KR) ..... 10-2017-0177832

(51) Int. Cl.
*G09G 3/3275* (2016.01)
*G09G 3/36* (2006.01)
*G09G 3/20* (2006.01)

(52) U.S. Cl.
CPC ..... *G09G 3/3275* (2013.01); *G09G 3/20* (2013.01); *G09G 3/3685* (2013.01); *G09G 2310/0267* (2013.01); *G09G 2310/0289* (2013.01); *G09G 2310/0297* (2013.01); *G09G 2310/08* (2013.01); *G09G 2320/0673* (2013.01); *G09G 2330/021* (2013.01)

(58) Field of Classification Search
None
See application file for complete search history.

(56) References Cited

U.S. PATENT DOCUMENTS

| | | | | |
|---|---|---|---|---|
| 6,693,617 | B2 * | 2/2004 | Sasaki | G09G 3/3688 345/98 |
| 9,564,105 | B2 * | 2/2017 | Smith | G09G 5/18 |
| 2008/0238852 | A1 * | 10/2008 | Tsai | G09G 3/20 345/98 |
| 2016/0078804 | A1 * | 3/2016 | Cho | G09G 3/20 345/213 |
| 2017/0186364 | A1 * | 6/2017 | Okamoto | H01L 29/7869 |
| 2017/0287425 | A1 * | 10/2017 | Koo | G09G 3/3696 |
| 2018/0096646 | A1 * | 4/2018 | Zeng | G09G 3/3688 |

FOREIGN PATENT DOCUMENTS

| | | | |
|---|---|---|---|
| CN | 107481682 | A | 12/2017 |
| KR | 10-2011-0075494 | A | 7/2011 |
| WO | WO 2019/015073 | A1 | 1/2019 |

* cited by examiner

*Primary Examiner* — Benjamin C Lee
*Assistant Examiner* — Emily J Frank
(74) *Attorney, Agent, or Firm* — Birch, Stewart, Kolasch & Birch, LLP

(57) ABSTRACT

A display device can include a gate driver configured to drive gate lines of a panel; a data driver configured to drive data lines of the panel; a timing controller configured to control operations of the gate driver and the data driver; and a level shifter integrated circuit (IC) configured to receive a plurality of control signals from the timing controller, and generate and output a plurality gate control signals for controlling driving of the gate driver, in which the plurality of control signals include an on clock and an off clock, and the level shifter IC stores the on clock and the off clock in buffers based on one or more control signals from the timing controller, generates a plurality of scan clocks by logically processing the on clock and the off clock, and outputs the plurality of scan clocks to the gate driver.

18 Claims, 9 Drawing Sheets

DISPLAY DEVICE

CROSS-REFERENCE TO RELATED APPLICATION

This application claims the priority benefit of Korean Patent Application No. 10-2017-0177832, filed in the Republic of Korea on Dec. 22, 2017, all of which is hereby incorporated by reference as if fully set forth herein.

BACKGROUND OF THE INVENTION

Technical Field

The present disclosure relates to a display device capable of minimizing transition of signals transmitted from a timing controller to a level shifter integrated circuit.

Background Art

Display devices for displaying images typically include liquid crystal displays (LCDs) using liquid crystal, organic light emitting diode (OLED) displays using OLEDs, and electrophoretic displays (EPDs) using electrophoretic particles.

A display device includes a panel for displaying an image through a pixel array, a gate driver and a data driver for driving the panel, and a timing controller.

The gate driver may be comprised of a plurality of gate integrated circuits (ICs) and be connected to the panel. Alternatively, the gate driver may be formed on a substrate together with a thin film transistor (TFT) array of the panel so that the gate driver may be mounted into the panel as a gate-in-panel (GIP) type.

The gate driver of the GIP type embedded into the panel receives a plurality of gate control signals from a level shifter integrated circuit (IC) controlled by the timing controller.

For example, the level shifter IC generates a plurality of different scan clocks by logically processing an on clock and an off clock which are received from the timing controller and are swung at a predetermined period, level-shifts the scan clocks, and supplies the level-shifted scan clocks to the gate driver.

However, since the on clock and the off clock are transmitted by successively repeated signal transition, power consumption increases and electromagnetic interference (EMI) increases. Therefore, it is desirable to reduce signal transition.

Particularly, it is desired that the level shifter IC applied to an OLED display device supplies scan clocks used to generate a scan pulse and sense clocks used to generate a sense pulse to the gate driver and further supplies carry clocks used as carry signals by the gate driver to the gate driver. Thus, the level shifter IC should receive three pairs of on clocks and off clocks for generating the scan clocks, the carry clocks, and the sense clocks from the timing controller.

As such, since the three pairs of on clocks and off clocks, which successively repeat signal transition, are transmitted from the timing controller to the level shifter IC, power consumption increases and EMI also increases.

BRIEF SUMMARY

Accordingly, the present disclosure is directed to a display device that substantially obviates one or more problems due to limitations and disadvantages of the background art.

In various embodiments, the present disclosure provides a display device capable of minimizing transition of signals transmitted from a timing controller to a level shifter IC.

Additional advantages, objects, and features of the disclosure will be set forth in part in the description which follows and in part will become apparent to those having ordinary skill in the art upon examination of the following or may be learned from practice of the disclosure. The objectives and other advantages of the disclosure may be realized and attained by the structure particularly pointed out in the written description and claims hereof as well as the appended drawings.

To achieve these objects and other advantages and in accordance with the purpose of the disclosure, as embodied and broadly described herein, a display device includes a gate driver configured to drive gate lines of a panel, a data driver configured to drive data lines of the panel, a timing controller configured to control operations of the gate driver and the data driver, and a level shifter integrated circuit (IC) configured to receive a plurality of control signals from the timing controller and generate and output a plurality gate control signals for controlling driving of the gate driver, in which the level shifter IC generates a plurality of scan clocks by logically processing an on clock and an off clock, which are received from the timing controller or buffered in the level shifter IC, according to control of the timing controller and the level shifter IC outputs the plural scan clocks to the gate driver.

The level shifter IC can receive a previous data rewrite control signal from the timing controller, or generate the previous data rewrite control signal through a logical combination of the plural control signals received from the timing controller. The level shifter IC can generate the plural scan clocks using the on clock and the off clock received from the timing controller when the previous data rewrite control signal is disabled. The level shifter IC can generate the plural scan clocks using the on clock and the off clock buffered in the level shifter IC when the previous data rewrite control signal is enabled. The timing controller may stop transmitting the on clock and the off clock when the previous data rewrite control signal is enabled.

The level shifter IC can include a scan clock generator. The scan clock generator can include a first multiplexer (MUX) configured to selectively output any one of an on clock of a current horizontal period received from the timing controller and an on clock of a previous horizontal period buffered by a first buffer, according to control of the previous data rewrite control signal, a second MUX configured to selectively output any one of an off clock of a current horizontal period received from the timing controller and an off clock of a previous horizontal period buffered by a second buffer, according to control of the previous data rewrite control signal, a logic processor configured to generate the plural scan clocks by logically processing the on clock and the off clock output respectively by the first MUX and the second MUX, and a level shifter configured to level-shift the plural scan clocks and output the level-shifted scan clocks to the gate driver. The first buffer can buffer and output an on clock which is fed back from the first MUX during every horizontal period, and the second buffer can buffer and output an off clock which is fed back from the second MUX during every horizontal period. It may be said that a "horizontal period" refers to the scan rate, or, in other words, the time required to display a single, horizontal line of the display.

The level shifter IC can further include a first logic gate configured to logically combine a gate start pulse, an on clock, and an off clock which are received from the timing controller and enable the previous data rewrite control signal when all of the gate start pulse, the on clock, and the off clock are logic high, and a second logic gate configured to logically combine the gate start pulse, the on clock, and the off clock and output a start pulse when only the gate start pulse is logic high.

The timing controller can include a transmitter configured to transmit serial timing information to the level shifter IC by serializing timing configuration information about the plural gate control signals and the previous data rewrite control signal is embedded into the serial timing information during every horizontal period. The level shifter IC can further include a receiver configured to generate an on clock and an off clock of a next horizontal period using the serial timing information received from the timing controller and output the on clock and the off clock of the next horizontal period to the scan clock generator.

The timing controller can transmit the timing configuration information about the on clock and the off clock to the level shifter IC when the previous data rewrite control signal is in an off state, and stop transmitting the timing configuration information about the on clock and the off clock when the previous data rewrite control signal is in an on state.

Upon transmitting the on clock and the off clock, the timing controller can further transmit a second on clock, a second off clock, a third on clock, and a third off clock. The level shifter IC can further include a sense clock generator configured to generate a plurality of sense clocks using the second on clock and the second off clock received from the timing controller or using the second on clock and the second off clocks buffered in the level shifter IC, according to control of the timing controller and output the plural sense clocks to the gate driver, and a carry clock generator configured to generate a plurality of carry clocks using the third on clock and the third off clock received from the timing controller or using the third on clock and the third off clocks buffered in the level shifter IC, according to control of the timing controller and output the plural carry clocks to the gate driver. Each of the sense clock generator and the carry clock generator can include the same elements as the scan clock generator. It may be said that the "same elements" refers to a configuration in which equivalent (or analogous) circuitry is implemented in each clock generator, and does not require that the only one set of circuitry is shared between the clock generators.

It is to be understood that both the foregoing general description and the following detailed description of the present disclosure are explanatory and are intended to provide examples and further explanation of the disclosure as claimed.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain principles of the disclosure. In the drawings.

DETAILED DESCRIPTION OF THE EMBODIMENTS

Reference will now be made in detail to embodiments of the present disclosure, examples of which are illustrated in the accompanying drawings. Wherever possible, the same reference numbers will be used throughout the drawings to refer to the same or like parts.

Figure 1:
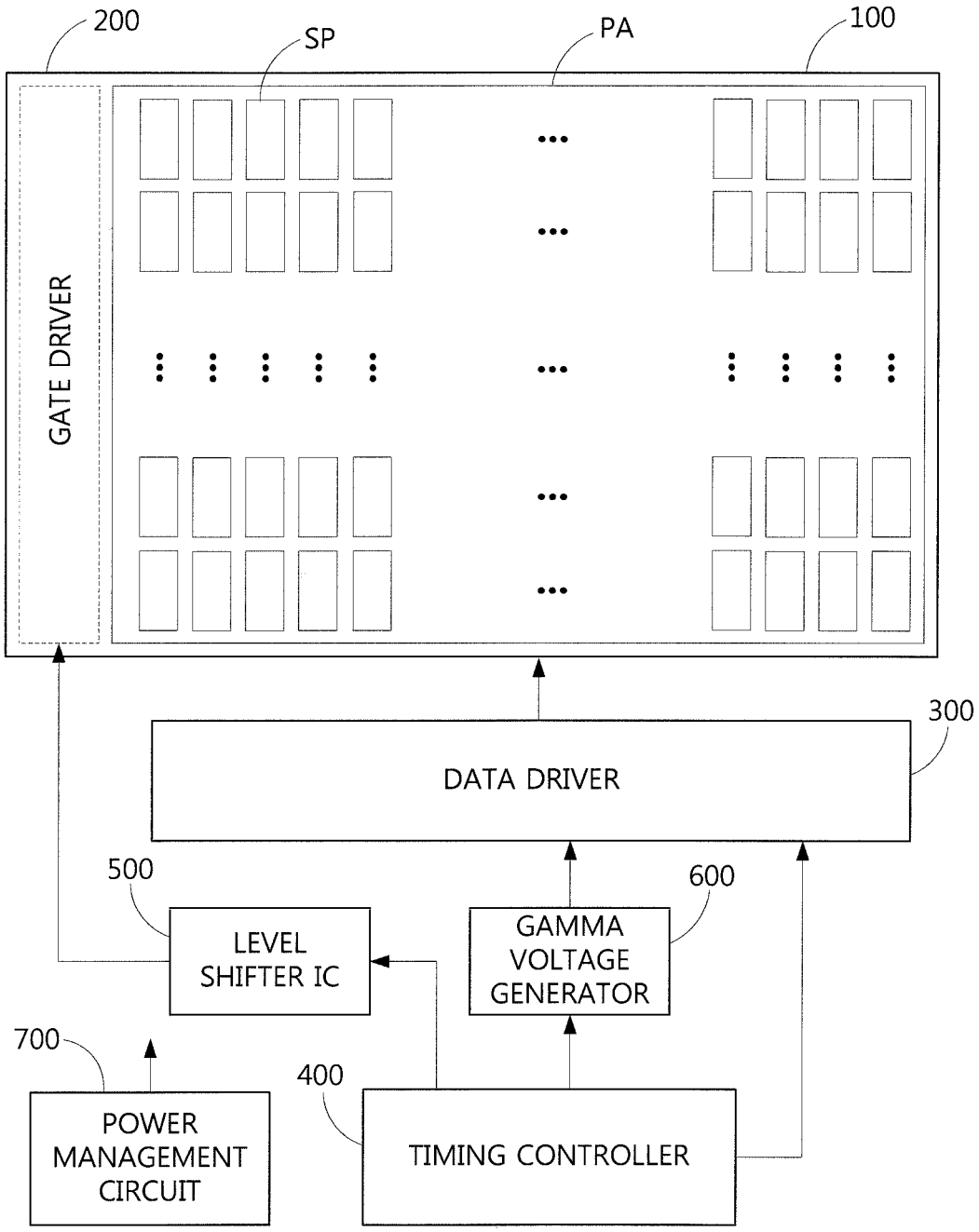
FIG. 1 is a block diagram schematically illustrating the construction of a display device according to an embodiment of the present disclosure.

FIG. 1 is a block diagram schematically illustrating the construction of a display device according to an embodiment of the present disclosure.

Referring to FIG. 1, the display device includes a panel 100, a gate driver 200 of a GIP type, a data driver 300, a timing controller 400, a level shifter IC 500, a gamma voltage generator 600, and a power management circuit 700. Each of the timing controller 400, the gamma voltage generator 600, and the power management circuit 700 may be comprised of an individual IC. The data driver 300 may be comprised of a plurality of data driving ICs.

The power management circuit 700 generates and outputs various driving voltages for operations of all circuit constructions of the display device, e.g., operations of the panel 100, the gate driver 200, the data driver 300, the timing controller 400, the level shifter IC 500, and the gamma voltage generator 600, using an input voltage which is externally received. For example, the power management circuit 700 generates and outputs, using the input voltage, a digital block driving voltage supplied to the timing controller 400, the data driver 300, and the level shifter IC 500, an analog block driving voltage supplied to the data driver 300, a gate-on voltage and a gate-off voltage supplied to the gate driver 200 and the level shifter IC 500, and driving voltage to drive the panel 100.

The panel 100 displays images through a pixel array PA including subpixels arranged in a matrix form. A basic pixel (e.g., pixel unit) can include at least three subpixels capable of expressing white by color mixture between white (W), red (R), green (G), and blue (B) subpixels. For example, the basic pixel can include R/G/B subpixels or W/R/G/B subpixels. The basic pixels can include R/G/B subpixels, W/R/G subpixels, B/W/R subpixels, or G/B/W subpixels.

The panel 100 can be one of various display panels, such as an LCD panel and an OLED panel. The panel can be a touch display panel having a touch sensing function.

The gate driver 200 is formed on a substrate together with a TFT array constituting the pixel array PA of the panel 100 and is embedded as a GIP type into non-display region(s) of both side parts or one side part of the panel 100. A pair of gate drivers 200 arranged at both side parts of the panel 100 simultaneously drives respective gate lines at both ends. The gate driver 200 receives a plurality of gate control signals from the level shifter IC 500 and performs a shift operation, thereby individually driving gate lines of the panel 100. The gate driver 200 supplies a scan signal of a gate-on voltage (or a gate-high voltage (VGH)) to a corresponding gate line during a driving period of each gate line and supplies a scan signal of a gate-off voltage (or a gate-low voltage (VGL)) to a corresponding gate line during a non-driving period of each gate line.

The data driver 300 receives a plurality of data control signals and image data from the timing controller 400 and latches the image data. The data driver 300 then converts the latched image data into analog data signals and individually supplies the analog data signals to data lines of the panel 100. The data driver 300 receives a plurality of reference gamma voltages from the gamma voltage generator 600 and segments the gamma voltages into a plurality of gradation voltages corresponding respectively to gradation values of the data. The data driver 300 converts digital data into an analog data voltage using the segmented gradation voltages and supplies the data voltage to each of the data lines of the panel 100.

The gamma voltage generator 600 generates a reference gamma voltage set including a plurality of different reference gamma voltages having different voltage levels and supplies the reference gamma voltage set to the data driver 300. The gamma voltage generator 600 can generate a plurality of reference gamma voltages corresponding to gamma voltage characteristics of the display device according to control of the timing controller 400 and supplies the reference gamma voltages to the data driver 300. The gamma voltage generator 600 may be comprised of a programmable gamma IC. The gamma voltage generator 600 receives gamma data from the timing controller 400, generates or adjusts reference gamma voltages according to the gamma data, and outputs the reference gamma voltages to the data driver 300.

The timing controller 400 receives image data and timing control signals from an external host system. The host system can be any one of a computer, a TV system, a set-top box, and a portable terminal system, such as a tablet or a cellular phone. The timing control signals include a dot clock, a data enable signal, a vertical synchronization signal, and a horizontal synchronization signal.

The timing controller 400 performs a variety of image processing, such as luminance correction for reduction of power consumption or picture quality correction, with respect to the image data and supplies the image-processed data to the data driver 300.

The timing controller 400 generates a plurality of data control signals for controlling the operation of the data driver 300 using the timing control signals and timing configuration information (e.g., start timing and pulse width) stored therein and supplies the data control signals to the data driver 300. The timing controller 400 generates a plurality of control signals for controlling the operation of the level shifter IC 500 and supplies the control signals to the level shifter IC 500.

Particularly, the timing controller 400 generates an on clock for determining a rising timing of each of GIP clocks generated by the level shifter IC 500 and an off clock for determining a falling timing of each of the GIP clocks and supplies the on clock and the off clock to the level shifter IC 500. Herein, the timing controller 400 can supply the on clock and the off clock only during a partial horizontal period and control the level shifter IC 500 to rewrite the on clock and the off clock of a previous period during the other periods. When the level shifter IC 500 rewrites the on clock and the off clock of the previous period, the timing controller 400 stops transmitting the on clock and the off clock so that transition of transmission signals can be minimized as compared with the related art in which the on clock and the off clock are repeatedly supplied.

The level shifter IC 500 generates and level-shifts a plurality of gate control signals under control of the timing controller 400 and supplies the level-shifted gate control signals to the gate driver 200.

For example, the level shifter IC 500 level-shifts a start pulse and a reset pulse received from the timing controller 400 and supplies the level-shifted start pulse and reset pulse to the gate driver 200. The level shifter IC 500 generates and level-shifts the plural GIP clocks by logically processing the on clock and the off clock which are received from the timing controller 400 or buffered therein and supplies the level-shifted GIP clocks to the gate driver 200. It may be said that a signal which is "buffered" refers to a signal which is stored in memory by an electronic circuit.

Particularly, the level shifter IC 500 stores the on clock and the off clock received from the timing controller 400 in a buffer to use the on clock and the off clock for logical processing. The level shifter IC 500 can generate the GIP clocks by logically processing the on clock and the off clock of a previous horizontal period, stored in the buffer, when a previous data re-write (hereinafter, PDRW) mode is enabled according to control of the timing controller 400.

The PDRW mode of the level shifter IC 500 can be enabled or disabled by receiving a PDRW control signal from the timing controller 400 or through a logical combination of the control signals received from the timing controller 400. This will be described later in detail.

In addition, when the panel 100 is an OLED panel, the data driver 300 can further include a sensing unit for sensing, using current or voltage, pixel current indicating electrical characteristics (e.g., a threshold voltage and mobility of a driving TFT and a threshold voltage of an OLED element) of each subpixel according to control of the timing controller 400, converting the pixel current into digital sensing data, and supplying the digital sensing data to the timing controller 400.

The timing controller 400 updates a compensation value of each subpixel using the sensing data of each subpixel received from the data driver 300. The timing controller 400 applies a corresponding compensation value to image data corresponding to each subpixel to compensate for luminance non-uniformity caused by a characteristic difference between sub pixels.

The gate driver 200 can supply a scan signal to gate lines for a scanning operation using scan clocks received from the level shifter IC 500 and supply a sense signal to gate lines for a sensing operation using sense clocks received from the level shifter IC 500. The gate driver can perform a shift operation using carry clocks received from the level shifter IC 500.

The level shifter IC 500 can generate a plurality of scan clocks, sense clocks, and carry clocks, using first on and off clocks, second on and off clocks, and third on and off clocks, respectively, which are received from the timing controller 400 or buffered therein. The level shifter IC 500 can output the generated clocks to the gate driver 200.

When the PDRW mode is enabled according to control of the timing controller 400, then the level shifter IC 500 uses the above three pairs of on clocks and off clocks which are buffered in the level shifter IC 500, and the timing controller 400 can stop transmitting the three pairs of on clocks and off clocks to the level shifter IC 500, thereby minimizing transition of transmission signals.

Figure 2:
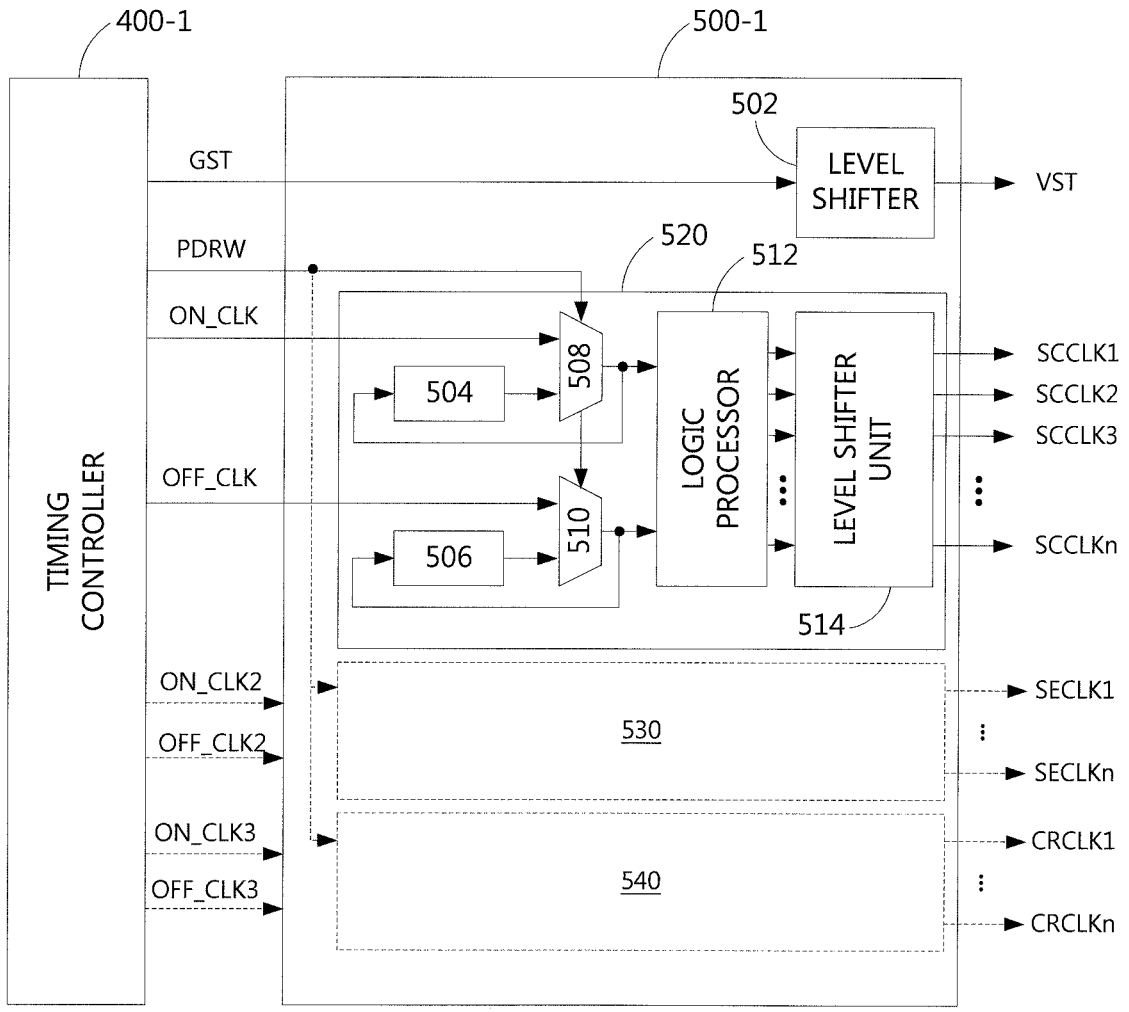
FIG. 2 is a block diagram of a timing controller and a level shifter IC according to an embodiment of the present disclosure.
Figure 3:
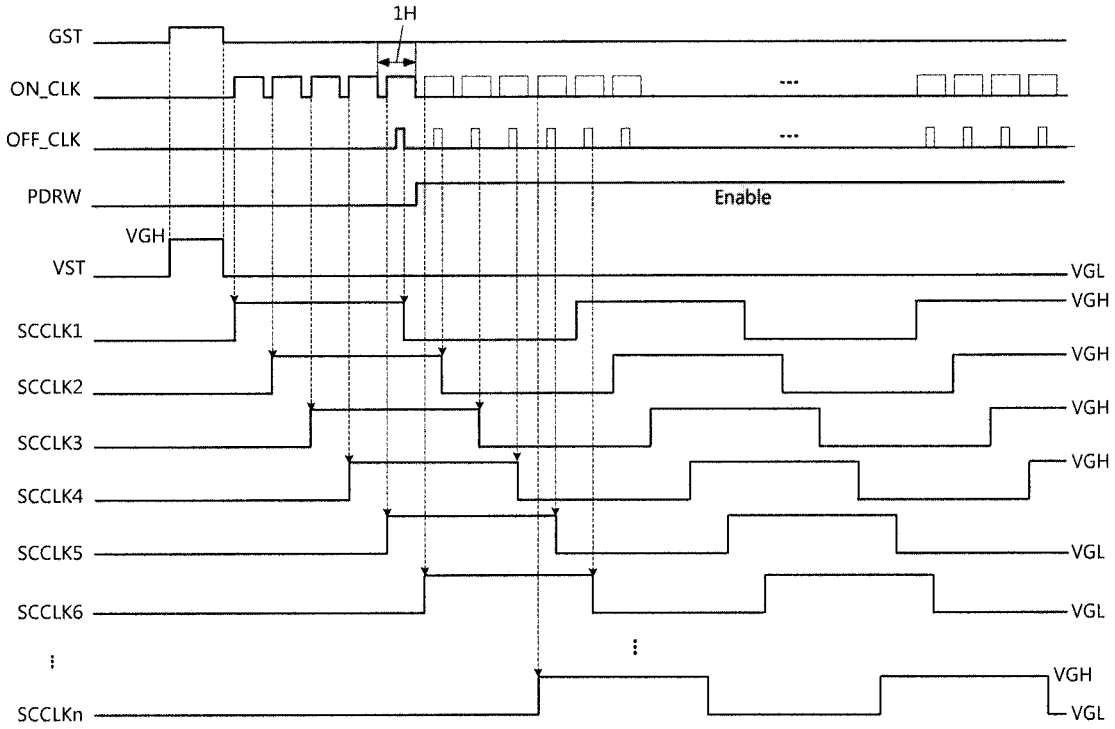
FIG. 3 is a timing chart of input and output signals of the level shifter IC according to an embodiment of the present disclosure.

FIG. 2 is a block diagram of a timing controller and a level shifter IC according to a first embodiment of the present disclosure. FIG. 3 is a timing chart of input and output signals of the level shifter IC illustrated in FIG. 2.

Referring to FIG. 2, a level shifter IC 500-1 can include a level shifter 502 and a scan clock generator 520.

Referring to FIGS. 2 and 3, the level shifter 502 level-shifts a first start pulse GST received from a timing controller 400-1 and outputs a second start pulse VST having a gate-on voltage VGH and a gate-off voltage VGL to the gate driver 200.

The scan clock generator 520 generates and level-shifts a plurality of scan clocks SCCLK1 to SCCLKn using an on clock ON_CLK and an off clock OFF_CLK, which are received from the timing controller 400-1 or buffered therein according to a PDRW control signal received from the timing controller 400-1, and the scan clock generator 520 outputs the level-shifted scan clocks to the gate driver 200.

The scan clock generator 520 includes a first multiplexer (hereinafter, MUX1) 508, a first buffer 504, a second multiplexer (hereinafter, MUX2) 510, a second buffer 506, a logic processor 512, and a level shifter unit 514.

During a disable period of the PDRW control signal, the timing controller 400-1 generates an on clock ON_CLK and an off clock OFF_CLK having one horizontal (1H) period and transmits the on clock ON_CLK and the off clock OFF_CLK to the level shifter IC 500-1. The timing controller 400-1 stops transmitting the on clock ON_CLK and an off clock OFF_CLK during an enable period of the PDRW control signal, thereby minimizing signal transition.

When the PDRW control signal received from the timing controller 400-1 is in a disabled state, the MUX1 508 and the MUX2 510 select the on clock ON_CLK of a 1H period and the off clock OFF_CLK of a 1H period, respectively, and supplies the selected clocks to the logic processor 512. The first buffer 504 and the second buffer 506 store the on clock and the off clock which are fed back from the MUX1 508 and the MUX2 510, respectively, during every horizontal period, in the form of data. In other words, according to a vehicle analogy, the timing controller can be viewed similar to the "electric starter motor" and the level shifter IC can be viewed similar to the "gasoline engine," in which the timing controller can provide the first few signals to get the level shifter IC started, and then the level shifter IC can take over and carry on generating the reference signals all by itself, internally, with the buffers and associated logic components.

When the PDRW control signal received from the timing controller 400-1 is in an enabled state, the MUX1 508 and the MUX2 510 select the on clock ON_CLK and off clock OFF_CLK of a previous horizontal period stored in the first buffer 504 and the second buffer 506, respectively, and output the selected clocks to the logic processor 512. In this instance, the first buffer 504 and the second buffer 506 store the on clock and the off clock fed back from the MUX1 508 and the MUX2 510, respectively, during every horizontal period in the form of data and update the on clock and the off clock. Therefore, during the enable period of the PDRW control signal, the MUX1 508 and the MUX2 510 can repeatedly output the on clock and the off clock which are stored in the first buffer 504 and the second buffer 506, respectively, during every horizontal period. The first buffer 504 can store rising edge information of the on clock as data during every horizontal period and the second buffer 506 can store falling edge information of the off clock as data.

The logic processor 512 outputs the plural scan clocks SCCLK1 to SCCLKn by logically processing the on clock ON_CLK and the off clock OFF_CLK received respectively from the MUX1 508 and the MUX2 510. The level shifter unit 514 level-shifts the plural scan clocks SCCLK1 to SCCLKn and outputs the level-shifted scan clocks to the gate driver 200. The logic processor 512 can generate the scan clocks SCCLK1 to SCCLKn by logically processing the rising edge information of the on clock ON_CLK received from the MUX1 508 and the falling edge information of the off clock OFF_CLK received from the MUX2 510. In this instance, the logic processor 512 can perform logical processing by further applying a rising edge delay value and a falling edge delay value which are preset in an internal memory.

Referring to FIG. 3, a rising time of each of the plural scan clocks SCCLK1 to SCCLKn, which rises to a gate-high voltage VGH from a gate-low voltage VGL, is determined by a rising edge of each of plural on clocks ON_CLK. A falling time of each of the plural scan clocks SCCLK1 to SCCLKn, which falls to a gate-low voltage VLH from a gate-high voltage VGH, is determined by a falling edge of each of plural off clocks OFF_CLK having phase differences with the on-clocks ON_CLK. A high period of each of the scan clocks SCCLK1 to SCCLKn partially overlaps with that of an adjacent scan clock.

In addition, the level shifter IC 500-1 applied to an OLED display device can further include a scan clock generator 530 and a carry clock generator 540 which have the same construction as the scan clock generator 520, as illustrated in FIG. 2.

The sense clock generator 530 generates a plurality of sense clocks SECLK1 to SECLKn using a second on clock ON_CLK2 and a second off clock OFF_CLK2 which are received from the timing controller 400-1 or buffered therein according to the PDRW control signal received from the timing controller 400-1, level-shifts the sense clocks SECLK1 to SECLKn and outputs the level-shifted sense clocks SECLK1 to SECLKn to the gate driver 200.

The carry clock generator 540 generates a plurality of carry clocks CRCLK1 to CRCLKn using a third on clock ON_CLK3 and a third off clock OFF_CLK3 which are received from the timing controller 400-1 or buffered therein according to the PDRW control signal received from the timing controller 400-1, level-shifts the carry clocks CRCLK1 to CRCLKn and outputs the level-shifted carry clocks CRCLK1 to CRCLKn to the gate driver 200.

Each of the sense clock generator 530 and the carry clock generator 540 includes the MUX1 508, the first buffer 504, the MUX2 510, the second buffer 506, the logic processor 512, and the level shifter unit 514 which are identically constructed as in the scan clock generator 520 and a detailed operation description thereof is as given above.

The first to third on clocks ON_CLK, ON_CLK2, and ON_CLK3 can have the same or different rising times. The first to third off clocks OFF_CLK, OFF_CLK2, and OFF_CLK3 can have the same or different falling times. The scan clocks SCCLK1 to SCCLKn, the sense clocks SECLK1 to SECLKn, and the carry clocks CRCLK1 to CRCLKn can have the same or different pulse types.

Figure 4:
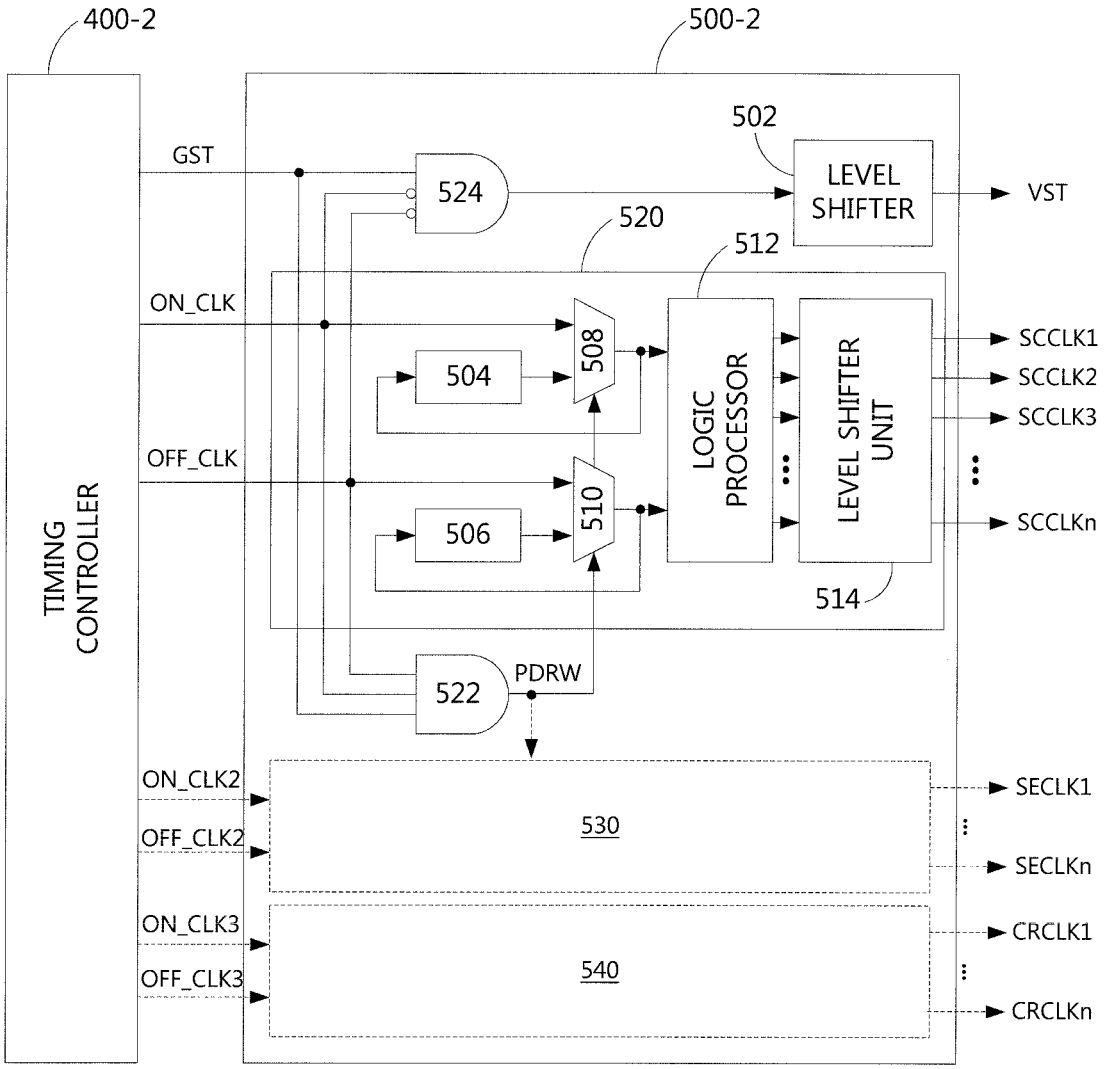
FIG. 4 is a block diagram of a timing controller and a level shifter IC according to another embodiment of the present disclosure.
Figure 5:
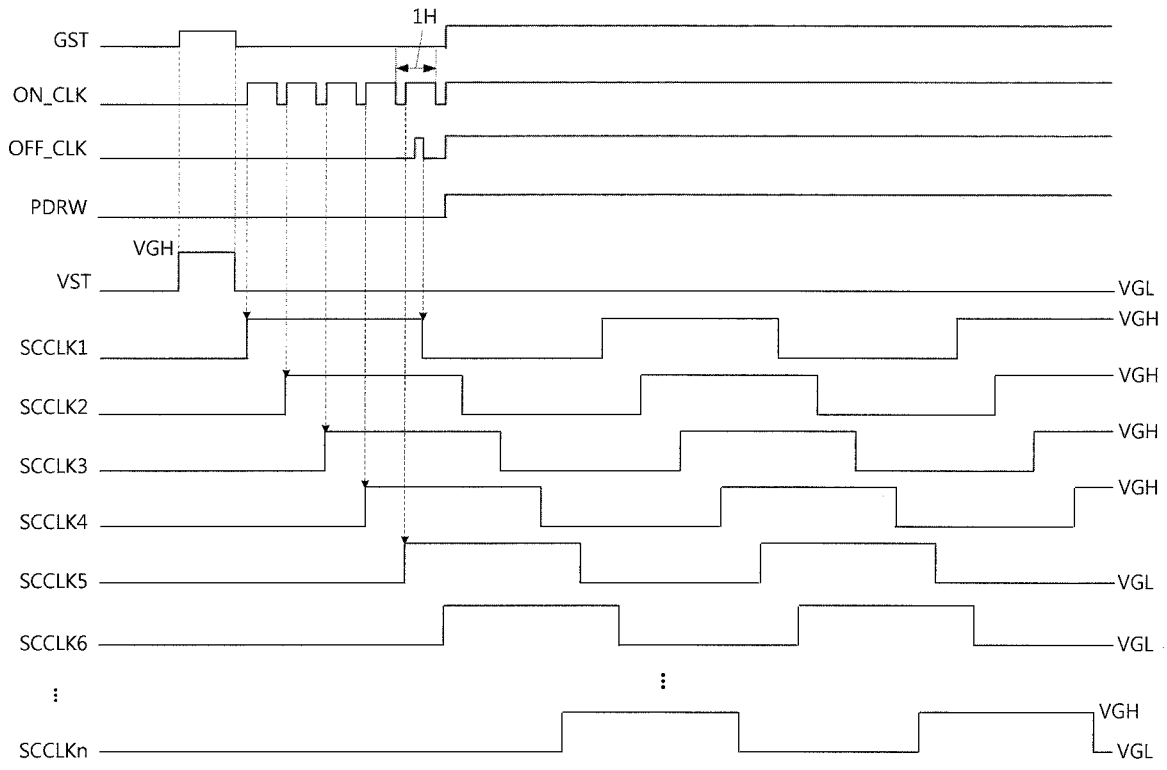
FIG. 5 is a timing chart of input and output signals of the level shifter IC according to an embodiment of the present disclosure.
Figure 6:
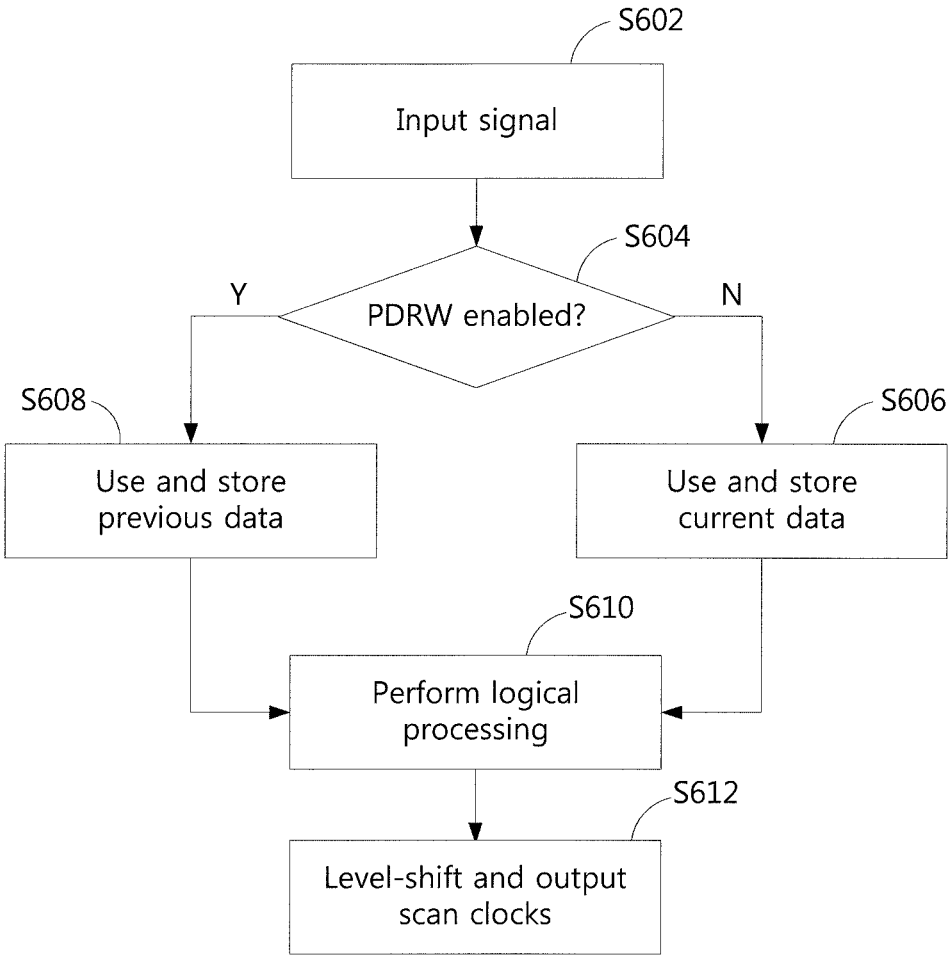
FIG. 6 is a flowchart illustrating a scan clock generation method of a level shifter IC according to an embodiment of the present disclosure.

FIG. 4 is a block diagram of a timing controller and a level shifter IC according to a second embodiment of the present disclosure. FIG. 5 is a timing chart of input and output signals of the level shifter IC illustrated in FIG. 4. FIG. 6 is a flowchart illustrating a scan clock generation method of a level shifter IC according to an embodiment of the present disclosure.

A level shifter IC 500-2 illustrated in FIG. 4 according to the second embodiment of the present disclosure is different from the level shifter IC 500-1 illustrated in FIG. 2 according to the first embodiment of the present disclosure in that the PDRW control signal is internally generated through a logical combination of a plurality of control signals received from a timing controller 400-2. A description of repetitive elements will be omitted.

Referring to FIG. 4, the timing controller 400-2 does not supply the PDRW control signal to the level shifter IC 500-2. Instead, the timing controller 400-2 modifies logic of a plurality of control signals GST, ON_CLK, and OFF_CLK such that a specific logical combination of the control signals may indicate an enable period and a disable period of the PDRW control signal (e.g., the timing controller can provide a specific pattern with existing start and clk signals, in order to instruct the level shifter IC to enter into the PDRW mode).

The level shifter IC 500-2 further includes a first logic (AND) gate 522 for generating the PDRW control signal by logically combining a first start pulse GST, an on clock ON_CLK, and an off clock OFF_CLK received from the timing controller 400-2 and a second logic gate 524 for generating a second start pulse VST by logically combining the first start pulse GST, the on clock ON_CLK, and the off clock OFF_CLK. For example, if the first start pulse GST, the on clock ON_CLK and the off clock OFF_CLK are all at the high level at the same time, then the PDRW mode can be enabled.

Referring to FIGS. 4 and 5, the first logical gate 522 enables the PDRW control signal when all of the first start pulse GST, the on clock ON_CLK, and the off clock OFF_CLK are high levels, and disables the PDRW control signal in other situations.

Referring to FIGS. 4 and 5, the second logic gate 524 generates the second start pulse VST when only the first start pulse GST is at a high level and the on clock ON_CLK and the off clock OFF_CLK are at a low level. The level shifter 501 level-shifts the second start pulse VST and outputs the level-shifted second start pulse VST to the gate driver 200.

Referring to FIGS. 4 and 6, the first logic (AND) gate 522 receives the first start pulse GST, the on clock ON_CLK, and the off clock OFF_CLK from the timing controller 400-2. When at least one of the first start pulse GST, the on clock ON_CLK, and the off clock OFF_CLK is a low level, the first logic (AND) gate disables a PDRW control signal (S604; "N"). When all of the first start pulse GST, the on clock ON_CLK, and the off clock OFF_CLK are high levels, the first logic (AND) gate 522 enables the PDRW control signal (S604; "Y").

If the PDRW control signal is disabled (S604; "N"), the MUX1 508 and the MUX2 510 selects and outputs the on clock ON_CLK and the off clock OFF_CLK of a current period received from the timing controller 400-2 and stores the selected on clock ON_CLK and off clock OFF_CLK in the first and second buffers 504 and 506 (S606), respectively.

If the PDRW control signal is enabled (S604; "Y"), the MUX1 508 and the MUX2 510 select the on clock ON_CLK and the off clock OFF_CLK of a previous period received from the first buffer 504 and the second buffer 506, respectively, and store the selected on clock ON_CLK and off clock OFF_CLK in the first and second buffers 504 and 506 (S608), respectively.

The logic processor 512 generates the scan clocks SCCLK1 to SCCLKn through logical processing using the on clock and the off clock OFF_CLK received respectively from the MUX1 508 and the MUX2 510. The level shifter unit 514 level-shifts the scan clocks and outputs the level-shifted scan clocks to the gate driver 200 (S610 and S612).

Figure 7:
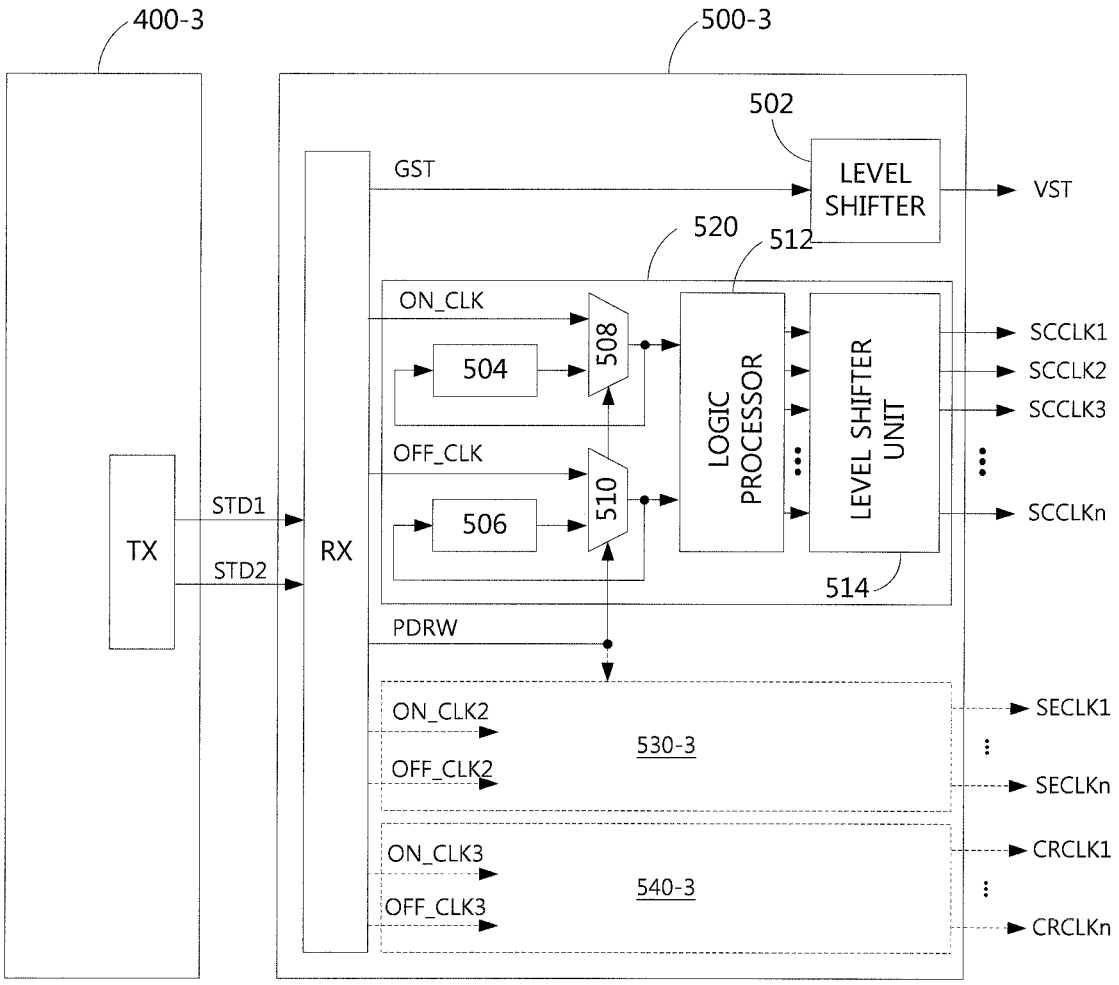
FIG. 7 is a block diagram of a timing controller and a level shifter IC according to another embodiment of the present disclosure.
Figure 8:
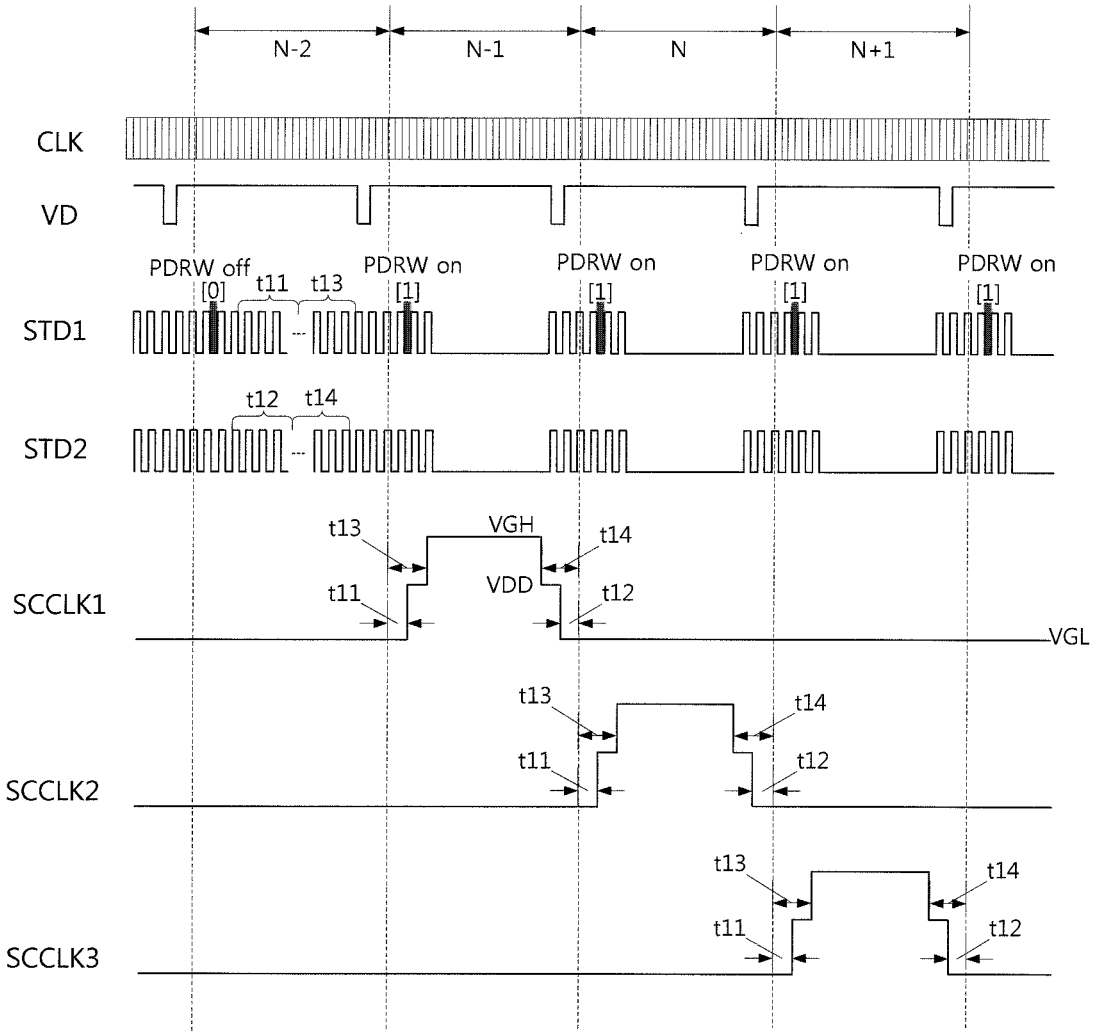
FIG. 8 is a timing chart of input and output signals of the level shifter IC according to an embodiment of the present disclosure.

FIG. 7 is a block diagram of a timing controller and a level shifter IC according to a third embodiment of the present disclosure. FIG. 8 is a timing chart of input and output signals of the level shifter IC illustrated in FIG. 7 according to the third embodiment of the present disclosure.

Referring to FIGS. 7 and 8, a timing controller 400-3 and a level shifter IC 500-3 transmit and receive a plurality of control information using a serial interface.

A transmitter TX of the timing controller 400-3 serializes rising timing information and falling timing information for a plurality of control signals and transmits first and second serial timing information STD1 and STD2 to a level shifter IC 500-3. In more detail, the timing controller 400-3 serializes rising timing information for the first to third on clocks ON_CLK, ON_CLK2, and ON_CLK3, serializes falling timing information for the first to third off clocks OFF_CLK, OFF_CLK2, and OFF_CLK3 in units of 1H, and transmits the first and second serial timing information STD1 and STD2 to the level shifter IC 500-3.

Particularly, the transmitter TX of the timing controller 400-3 embeds the PDRW control signal into any one of the first and second serial timing information STD1 and STD2 and transmits the first and second serial timing information STD1 and STD2 into which PDRW control signal is embedded to the level shifter IC 500-3. In this instance, the transmitter TX of the timing controller 400-3 further transmits a clock CLK and a valid data signal VD indicating an enable period in which the timing information is valid to the level shifter IC 500-3 during every horizontal period. The timing controller 400-3 transmits timing information about the on clocks ON_CLK, ON_CLK2, and ON_CLK3, and the off clocks OFF_CLK, OFF_CLK2, and OFF_CLK3, when the PDRW control signal is in an off state (e.g., 0) and does not transmit the timing information when the PDRW control signal is in an on state (e.g., 1), thereby minimizing transition of transmission signals.

A receiver RX of the level shifter IC 500-3 receives the first and second serial timing information STD1 and STD2 received from the timing controller 400-3 in synchronization with the clock CLK. The receiver RX generates a plurality of control signals GST, ON_CLK to ON_CLK3, and OFF_CLK to OFF_CLK3 using the first and second serial timing information STD1 and STD2 transmitted during an enable period of the valid data signal VD, and outputs the generated control signals during the next horizontal period. For example, the receiver RX of the level shifter IC 500-3 generates the plural control signals during an (N−1)-th horizontal period using the timing information received during an (N−2)-th horizontal period.

The first serial timing information STD1 can include rising timing information of the on clocks ON_CLK to ON_CLK3. The second serial timing information STD2 can include falling timing information of the off clocks OFF_CLK to OFF_CLK3. The first serial timing information STD1 can further include the PDRW control signal during every horizontal period.

Referring to FIG. 8, each of the scan clocks SCCLK1 to SCCLKn can include a rising gate pulse modulation (GPM)

duration and a falling GPM duration which pass through a middle voltage (VDD) at a rising edge and a falling edge, respectively.

The logic processor 512 determines the rising GPM duration of each scan clock SCCLK by first and second timing information t11 and t13 of the on clock ON_CLK and determines the falling GPM duration of each scan clock SCCLK by first and second timing information t12 and t14 of the off clock OFF_CLK.

If the PDRW control signal is in an off state, e.g., the PDRW control signal is disabled, the MUX1 508 and the MUX2 510 select and output the on clock ON_CLK and off clock OFF_CLK of a current period received from the receiver RX and store the selected clocks in the first and second buffers 504 and 506. If the PDRW control signal is in an on state, e.g., if the PDRW control signal is enabled, the MUX1 508 and the MUX2 510 select and output the on clock ON_CLK and the off clock OFF_CLK of a previous period received from the first and second buffers 504 and 506 and store the selected clocks in the first and second buffers 504 and 506.

The logic processor 512 generates the plural scan clocks SCCLK1 to SCCLKn by performing logical processing using the on clock ON_CLK and the off clock OFF_CLK received from the MUX1 508 and the MUX2 510, level-shifts the scan clocks, and outputs the level-shifted scan clocks to the gate driver 200.

The sense clock generator 530 and the carry clock generator 540 operate in the same manner as the scan clock generator 520. The sense clock generator 530 and the carry clock generator 540 generate the sense clocks SECLK1 to SECLKn and carry clocks CRCLK1 to CRCLKn, respectively, and output the generated clocks to the gate driver 200. The sense clocks SECLK1 to SECLKn and the carry clocks CRCLK1 to CRCLKn may not include a GPM duration.

In a display device according to an embodiment, the level shifter IC generates a plurality of GIP clocks by rewriting an on clock and an off clock received from the timing controller and timing information of the on and off clocks so that transition of signals transmitted from the timing controller to the level shifter IC is minimized and thus power consumption and EMI can be reduced.

In a display device according to an embodiment, the timing controller and the level shifter IC transmit and receive timing information using a serial interface so that the number of transmission wirings between the timing controller and the level shifter IC can be reduced further, even when the number of control signals used in the level shifter IC increases. Therefore, since the number of output pins of the timing controller, the number of input pins of the level shifter IC, and the number of routing wirings and a routing area between the timing controller and the level shifter IC on a printed circuit board (PCB) can be reduced, manufacturing costs can be reduced and EMI can be reduced.

Figure 9:
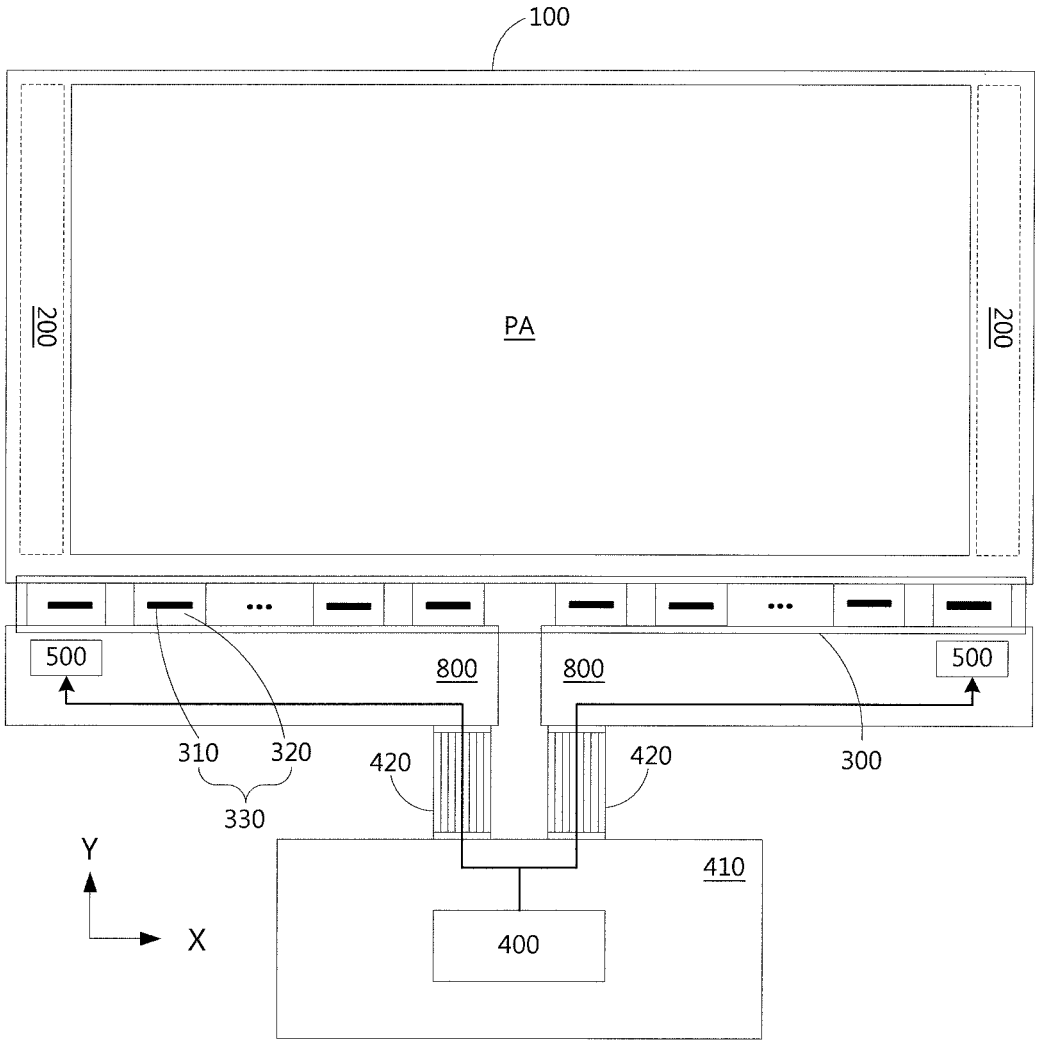
FIG. 9 is a diagram illustrating a system construction of a display device according to an embodiment of the present disclosure.

FIG. 9 is a diagram illustrating a system construction of a display device according to an embodiment of the present disclosure.

Referring to FIG. 9, each of the timing controller 400, the power management circuit 700 (illustrated in FIG. 1), and the gamma voltage generator 600 (illustrated in FIG. 1) is comprised of an individual IC and is mounted in a control PCB 410. The level shifter IC 500 is mounted in a source PCB 800. A flat flexible cable (FFC) 420 is interlocked and connected between the control PCB 410 and the source PCB 800 through a connector. According to the size of the panel 100, one or more source PCBs 800 are included. Each of the plural source PCBs 800 is connected to the control PCB 410 through each of the plural FFCs 420 located at an inner side in an X-axis direction.

The data driver 300 (illustrated in FIG. 1) is comprised of a plurality of data ICs 310 for dividedly driving data lines of a pixel array PA. Each of the plural data ICs 310 is individually mounted into each circuit film 320 such as a chip-on-film (COF) 330. A plurality of COFs 330 into which the data ICs 310 are mounted are bonded and connected to the panel 100 and the source PCB 800 through an anisotropic conductive film (ACF) by tape automated bonding (TAB) and are located between the panel 100 and the source PCB 800.

The level shifter IC 500 is mounted into the source PCB 800 near the gate driver 200. Each of a plurality of level shifter ICs 500 is mounted at an outer side near to the gate driver 200 in an X-axis direction on each of the plural source PCBs 800. Each level shifter IC 500 supplies a plurality of gate control signals to the gate driver 200 through the COF 330 near the gate driver 200.

As compared with the situation in which the level shifter IC 500 is mounted into the control PCB 410, the level shifter IC 500 mounted in the source PCB 800 can reduce the number of transmission wirings passing through the control PCB 410, the FFC 420, the connector, and the source PCB 800.

In a display device according to an embodiment, the level shifter IC generates a plurality of GIP clocks by rewriting an on clock and an off clock by itself, which were previously received from the timing controller and timing information of the on and off clocks so that transition of signals transmitted from the timing controller to the level shifter IC is minimized and thus power consumption can be reduced and EMI can be reduced.

In a display device according to an embodiment, the timing controller and the level shifter IC transmit and receive timing information using a serial interface by the timing controller and the level shifter IC so that the number of transmission wirings between the timing controller and the level shifter IC can be reduced further, even when the number of control signals used in the level shifter IC increases. Therefore, since the number of output pins of the timing controller, the number of input pins of the level shifter IC, and the number of routing wirings and a routing area between the timing controller and the level shifter IC on a PCB can be reduced, manufacturing costs can be reduced and EMI can be reduced.

A display device according to an embodiment and an interface method thereof are applicable to all display devices, such as an OLED display and an LCD.

It will be apparent to those skilled in the art that various modifications and variations can be made in the present disclosure without departing from the spirit and scope of the disclosure. Thus, the present disclosure is intended to cover the modifications and variations of this disclosure within the scope of the appended claims and their equivalents.

The various embodiments described above can be combined to provide further embodiments. These and other changes can be made to the embodiments in light of the above-detailed description. In general, in the appended claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. A display device, comprising:

a gate driver configured to drive gate lines of a panel;

a data driver configured to drive data lines of the panel;

a timing controller configured to control operations of the gate driver and the data driver; and a level shifter integrated circuit (IC) configured to receive a plurality of control signals from the timing controller, and generate and output a plurality gate control signals for controlling driving of the gate driver, wherein the plurality of control signals include a gate start pulse, an on clock and an off clock, and wherein the level shifter IC stores the on clock and the off clock in buffers based on one or more control signals from the timing controller, generates a plurality of scan clocks by logically processing the on clock and the off clock, and outputs the plurality of scan clocks to the gate driver, wherein the level shifter IC comprises a scan clock generator, and wherein the scan clock generator comprises:

a first multiplexer (MUX) configured to selectively output any one of an on clock of a current horizontal period received from the timing controller and an on clock of a previous horizontal period buffered by a first buffer based on a previous data rewrite (PDRW) control signal, the output of the first MUX being based on the gate start pulse, the on clock and the off clock;

a second MUX configured to selectively output any one of an off clock of a current horizontal period received from the timing controller and an off clock of a previous horizontal period buffered by a second buffer based on the PDRW control signal, the output of the second MUX being based on the gate start pulse, the on clock and the off clock;

a logic processor configured to generate the plurality of scan clocks by logically processing the on clock and the off clock output respectively by the first MUX and the second MUX; and a level shifter configured to level-shift the plurality of scan clocks and output the level-shifted scan clocks to the gate driver.

2. The display device of claim 1, wherein the level shifter IC:

receives the PDRW control signal from the timing controller or generates the PDRW control signal itself based on a logical combination of the plurality of control signals received from the timing controller, generates the plurality of scan clocks using the on clock and the off clock received from the timing controller when the PDRW control signal is disabled, and generates the plurality of scan clocks using the on clock and the off clock stored in the buffers in the level shifter IC when the previous data rewrite control signal is enabled, and wherein the timing controller stops transmitting the on clock and the off clock while the previous data rewrite control signal is enabled.

3. The display device of claim 2, wherein the first buffer buffers and outputs an on clock which is fed back from the first multiplexer during every horizontal period, and wherein the second buffer buffers and outputs an off clock which is fed back from the second multiplexer during every horizontal period.

4. The display device of claim 3, wherein the level shifter IC further comprises:

a first logic gate configured to logically combine the gate start pulse, the on clock and the off clock which are received from the timing controller, and enable the PDRW control signal when all of the gate start pulse, the on clock and the off clock are logic high; and a second logic gate configured to logically combine the gate start pulse, the on clock and the off clock, and output a start pulse when only the gate start pulse is logic high.

5. The display device of claim 3, wherein the timing controller comprises a transmitter configured to transmit serial timing information to the level shifter IC by serializing timing configuration information for the plurality of gate control signals and the PDRW control signal, and wherein the level shifter IC further comprises a receiver configured to generate an on clock and an off clock of a next horizontal period using the serial timing information received from the timing controller, and output the on clock and the off clock of the next horizontal period to the scan clock generator.

6. The display device of claim 5, wherein the PDRW control signal is embedded in the serial timing information during every horizontal period.

7. The display device of claim 5, wherein the timing controller transmits the timing configuration information about the on clock and the off clock to the level shifter IC when the PDRW control signal is in an off state, and stops transmitting the timing configuration information about the on clock and the off clock when the PDRW control signal is in an on state.

8. The display device of claim 1, wherein, upon transmitting the on clock and the off clock to the level shifter IC, the timing controller further transmits a second on clock, a second off clock, a third on clock, and a third off clock to the level shifter IC, and wherein the level shifter IC further comprises:

a sense clock generator configured to generate a plurality of sense clocks using the second on clock and the second off clock received from the timing controller or using the second on clock and the second off clocks buffered in the level shifter IC according to control of the timing controller, and output the plurality of sense clocks to the gate driver, and a carry clock generator configured to generate a plurality of carry clocks using the third on clock and the third off clock received from the timing controller or using the third on clock and the third off clocks buffered in the level shifter IC according to control of the timing controller, and output the plurality of carry clocks to the gate driver.

9. The display device of claim 8, wherein each of the sense clock generator and the carry clock generator includes the same elements as the scan clock generator.

10. The display device of claim 2, wherein adjacent scan clocks among the plurality of scan clocks partially overlap with each other.

11. A display device, comprising:

a gate driver;

a level shifter integrated circuit (IC) including a first buffer and a second buffer; and a timing controller configured to:

transmit a first start pulse signal, an on clock signal and an off clock signal to the level shifter IC, wherein the level shifter IC is configured to:

receive the first start pulse signal, the on clock signal and the off clock signal from the timing controller, in response to a previous data rewrite (PDRW) control signal being enabled based on the first start pulse signal, the on clock signal, and the off clock signal, store the on clock signal in the first buffer and store the off clock signal in the second buffer, generate a plurality of scan clock signals based on the on clock signal and the off clock signal received from the timing controller or generate the plurality of scan clock signals based on the on clock signal stored in the first buffer and the off clock signal stored in the second buffer, according to whether the PDRW control signal is enabled, and transmit the plurality of scan clock signals to the gate driver, wherein the timing controller stops transmitting the on clock signal and the off clock signal to the level shifter IC when the PDRW control signal is enabled, wherein the level shifter IC includes a first multiplexer (MUX) including a first input connected to the timing controller, a second input connected to the first buffer and a third input configured to receive the PDRW control signal, wherein the first MUX is further configured to output the on clock signal received from the timing controller or output the on clock signal stored in the first buffer, according to the PDRW control signal, wherein the level shifter IC further includes a second MUX including a first input connected to the timing controller, a second input connected to the second buffer and a third input configured to receive the PDRW control signal, and wherein second MUX is configured to output the off clock signal received from the timing controller or output the off clock signal stored in the second buffer, according to the PDRW control signal.

12. The display device of claim 11, wherein the timing controller transmits the PDRW control signal to the level shifter IC.

13. The display device of claim 12, wherein the timing controller embeds the PDRW control signal in serialized timing information and transmits the serialized timing information to the level shifter IC.

14. The display device of claim 11, wherein the level shifter IC internally generates the PDRW control signal based on the first start pulse signal, the on clock signal and the off clock signal received from the timing controller.

15. The display device of claim 14, wherein the level shifter IC further includes a first AND gate configured to:

receive the first start pulse signal, the on clock signal and the off clock signal from the timing controller, and output the PDRW control signal based on a logical combination of the first start pulse signal, the on clock signal and the off clock signal.

16. The display device of claim 14, wherein the level shifter IC further includes:

a level shifter, and a second AND gate configured to:

receive the first start pulse signal, the on clock signal and the off clock signal from the timing controller, and output a second start pulse to the level shifter when the first start pulse signal has a different logical level than both the on clock signal and the off clock signal.

17. A display device, comprising:

a gate driver;

a level shifter integrated circuit (IC) including a first buffer and a second buffer; and a timing controller configured to:

transmit a first start pulse signal, an on clock signal and an off clock signal to the level shifter IC, wherein the level shifter IC is configured to:

receive the first start pulse signal, the on clock signal and the off clock signal from the timing controller, in response to a previous data rewrite (PDRW) control signal being enabled based on the first start pulse signal, the on clock signal and the off clock signal, store the on clock signal in the first buffer and store the off clock signal in the second buffer, generate a plurality of scan clock signals based on the on clock signal and the off clock signal received from the timing controller or generate the plurality of scan clock signals based on the on clock signal stored in the first buffer and the off clock signal stored in the second buffer, according to whether the PDRW control signal is enabled, and transmit the plurality of scan clock signals to the gate driver, wherein the level shifter IC includes a first multiplexer (MUX) including a first input connected to the timing controller, a second input connected to the first buffer and a third input configured to receive the PDRW control signal, wherein the first MUX is further configured to output the on clock signal received from the timing controller or output the on clock signal stored in the first buffer, according to the PDRW control signal, wherein the level shifter IC further includes a second MUX including a first input connected to the timing controller, a second input connected to the second buffer and a third input configured to receive the PDRW control signal, and wherein second MUX is configured to output the off clock signal received from the timing controller or output the off clock signal stored in the second buffer, according to the PDRW control signal.

18. The display device of claim 17, wherein the timing controller stops transmitting the first start pulse signal, the on clock signal and the off clock signal to the level shifter IC when the PDRW control signal is enabled.

* * * * *